United States Patent [19]

Savino

[11] Patent Number: 4,874,466

[45] Date of Patent: Oct. 17, 1989

[54] PAPER MAKING FILLER COMPOSITION AND METHOD

[75] Inventor: Carolyn A. Savino, Naperville, Ill.

[73] Assignee: Nalco Chemical Company, Naperville, Ill.

[21] Appl. No.: 250,224

[22] Filed: Sep. 28, 1988

Related U.S. Application Data

[63] Continuation of Ser. No. 920,092, Oct. 17, 1986, abandoned.

[51] Int. Cl.[4] ..... D21H 3/78; D21H 3/48

[52] U.S. Cl. ..... 162/164.3; 162/164.6; 162/181.5; 162/183

[58] Field of Search ..... 162/168.3, 164.3, 164.6, 162/181.1, 181.2–181.6, 183; 106/448

[56] References Cited

U.S. PATENT DOCUMENTS 3,425,855 2/1969 Barksdale et al. ..... 106/448
4,610,801 9/1986 Matthews et al. ..... 252/181

FOREIGN PATENT DOCUMENTS 2125838 3/1984 United Kingdom .

OTHER PUBLICATIONS

Alince & LePoutre, "Light Scattering of Filled Sheets: The Effect of Pigment Dispersion", *TAPPI*, vol. 64, No. 11, (Nov. 1981), pp. 117 & 118.

Alince, "Positively Charged $TiO_2$ Pigment in Papermaking", *Paperi Ja Puu*, vol. 65, No. 3, (1978), pp. 123–125, 136.

*Primary Examiner*—Peter Chin

*Attorney, Agent, or Firm*—Joan I. Norek; John G. Premo; Donald G. Epple

[57] ABSTRACT

An improved paper making filler composition is comprised of the combination of a paper making pigment admixed with a cationic water soluble polymer in an aqueous dispersion, wherein the cationic water soluble polymer is present in said dispersion in the amount of from 0.1 to 2.0 weight percent based on said pigment, the cationic water soluble polymer being selected from the group consisting of polymers comprised of at least fifty percent by weight of repeating units consisting of a quaternary ammonium salt moiety and from 2 to 10 carbons, wherein the carbons form alkyl or aryl moieties or combinations thereof, may be substituted with hydroxy, amine, or halide, and polyaluminum chloride and mixtures thereof. An improved method of treating a paper making pulp comprises admixing with water such a cationic water soluble polymer selected from the group consisting of polymers, adding to said mixture of water and cationic water soluble polymer, with agitation, an amount of paper making pigment to form a dispersion wherein said cationic water soluble polymer is present in the amount of from 0.1 to 2.0 weight percent based on said pigment, and admixing the dispersion with paper making pulp.

4 Claims, No Drawings

PAPER MAKING FILLER COMPOSITION AND METHOD

This is a continuation of application Ser. No. 920,092, filed Oct. 17, 1986, abandoned.

TECHNICAL FIELD OF THE INVENTION

The present invention is in the technical field of paper manufacture, or paper making, and in particular is in the technical field of fillers used in paper making, i.e., materials that are incorporated into paper's fibrous web to improve its optical properties, such as opacity or brightness.

BACKGROUND OF THE INVENTION

In paper making there is generally a need to increase the opacity and brightness of paper by the use of fillers, for instance titanium dioxide which is incorporated into the fibrous paper web by wet-end addition into the paper making process. Titanium dioxide is a white pigment well known as a filler additive. It is, however, an expensive additive. A reduction of the amount of titanium dioxide required to achieve the standard for a given paper grade utilizing this filler would be a tremendous cost savings. For some paper grades, for instance highly filled light weight paper, there is a great demand for higher levels of brightness and opacity but the amounts of titanium dioxide now necessary for such levels are cost prohibitive.

The cost problems attendant on the use of titanium dioxide filler are severely aggravated by the standard method of retention of the filler on the paper fibers. This standard method is by way of agglomeration of the primary or ultimate titanium dioxide particles into aggregates of particles sufficiently large to be caught and retained within the fibrous web of paper. In this agglomeration method, retention aids are used to flocculate the titanium dioxide particles. Such retention aids are generally polymeric materials believed to act by bridging the discrete particles, retention aid molecules adhering to a plurality of titanium dioxide particles by adsorption. Aggregates sufficiently large for retention by such standard filtration methods, however, are far from optimum particle size for the opacifying function of the filler. A filler's opacifying ability is a function of its ability to scatter light, i.e., return incident light by reflection. Scattering depends on the refractive index of the filler, and increases with the magnitude of the difference in the refractive index between filler and surrounding medium. For a given filler its refractive index is a constant. The light scattering for a given amount of filler, however, depends also on the surface area of the filler available for such function. Aggregation or agglomeration of many discrete particles into fewer and larger units greatly diminishes the surface area of the filler available for light scattering. Hence the opacifying efficiency of a filler such as titanium dioxide would be increased if its particles were present in use environment as well dispersed and distinct, or small clusters of particles approaching the original primary particle size. Increasing the opacifying efficiency would permit reduction of the titanium dioxide used to provide opacity of the standard desired.

In addition, with the standard agglomeration method some of the titanium dioxide will not be retained on the paper web, wasting this expensive filler and at times loading the white water system. Hence increasing retention of the titanium dioxide on the paper web will reduce the amount required for a given standard.

Another deficiency of the standard method is the energy consumption, and its concommitant costs, required to keep titanium dioxide suspensions from settling during processing. Intense mechanical agitation is required to overcome titanium dioxide's fast settling rate. It would be a cost savings to provide more stable titanium dioxide dispersions.

The agglomeration and filtration method can also lead to "two-sidedness", an undesirable condition where there is a higher concentration of filler on the felt side of the paper than on the wire side. The two sides will then differ as to brightness, print quality, pick resistance and other properties. Hence it is highly desirable to provide a method of titanium dioxide retention that more evenly distributes this pigment throughout the paper web, avoiding two-sidedness and paper curling.

Given these problems, there is a serious need for a means to stabilize titanium dioxide suspensions used in wet-end application to paper and a means to promote the attachment of titanium dioxide as discrete pigment particles or small clusters of particles to paper fibers evenly without interference with the interfiber bonding. A combination of higher retention and increase of optical properties would reduce the costs of using titanium dioxide for all paper grades. For the now expanding lightweight, highly filled paper industry, such combination would provide significantly increased brightness and opacity with small filler additions. Further, stronger titanium dioxide attachment to paper fibers may decrease on-machine dusting problems sometimes encountered.

Titanium dioxide is also known to auto-flocculate, i.e., convert from discrete particles to larger aggregates, when introduced into hard water streams present in many paper machine systems. A high retention, low particle size, method and means must also inhibit such auto-flocculation mechanism to be widely commercially acceptable.

DISCLOSURE OF THE INVENTION

The present invention provides a paper making filler composition, and a method of treating a paper making pulp utilizing such composition. Such composition is comprised of a pigment, preferably titanium dioxide, admixed wth a cationic water soluble polymer in a aqueous dispersion, wherein the cationic water soluble polymer is present in an amount of from 0.1 to 2.0 weight percent based on pigment, and the cationic water soluble polymer is selected from the group consisting of polymers comprised of at least fifty percent by weight of repeating units consisting of a quaternary ammonium salt moiety and from 2 to 10 carbon atoms, wherein the carbon atoms form alkyl or aryl moieties or combinations of alkyl and aryl moieties which may be substituted with hydroxy, amine or halide, and polyaluminum chloride and mixtures thereof.

In preferred embodiment, the cationic water soluble polymer is one having at least fifty percent by weight, and more preferably at least 80 percent by weight of repeating units having the formula

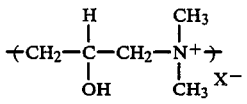

wherein X is a halide, such as chloride, or a sulfate or the like, and such polymer includes the quaternary ammonium salts of epichlorohydrin dimethylamine copolymers such as poly epichlorohydrin/dimethylamine, preferably with a molecular weight of from 1,000 to 100,000, more preferably with a molecular weight of from 5,000 to 50,000, and even more preferably with a molecular weight of from 10,000 to 30,000, which can be prepared by methods well known in the art.

In other preferred embodiments, the cationic water soluble polymer is one having at least fifty percent by weight, and more preferably at least 80 percent by weight of repeating units having one of the following formulas wherein X is as defined above:

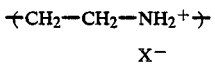

such as ethylene dichloride/ammonia polymers, preferably those having molecular weight of from 2,000 to 60,000, and more preferably those having a molecular weight from 5,000 to 40,000, which can be prepared by methods well known in the art; or

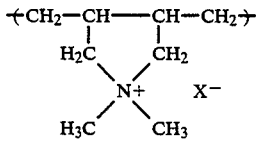

such as poly diallyldimethylammonium chloride, preferably having a molecular weight of from 25,000 to 150,000, and more preferably having a molecular weight of from 25,000 to 100,000, which can be prepared by methods well known in the art; or

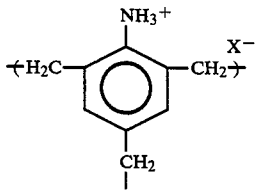

such as aniline/formaldehyde copolymers, preferably having a molecular weight of less than 5,000, and more preferably less than 2,000, which can be prepared by methods well known in the art.

In further preferred embodiment the cationic water soluble polymer is a polyaluminum chloride having the formula of $[Al_n(OH)_mCl_{3n-m}]_x$ preferably wherein x is an integer from about 10 to 20 and more preferably about 15, formed by reaction of any base, or salt of a weak acid and a strong base, with aluminum chloride, and preferably such a polyaluminum chloride combined with one of the quaternary ammonium salt polymers defined above, and more preferably a mixture comprised of from about 85 to 95 weight percent of the polyaluminum chloride and from 5 to 15 weight percent of poly epichlorohydrin/dimethylamine.

The above defined quaternary ammonium saltcontaining repeating units with from 2 to 10 carbons are those wherein the quaternary nitrogen may be a pendant group or within the polymer backbone or within a pendant alkyl group, such as the heterocyclic moiety formed in the diallyldimethylammonium chloride, but other than such carbon to nitrogen bonds such repeating units are comprised wholly of carbon to carbon linkages and any hydroxy, amine or halide substituents are pendant groups.

The method comprises admixing with water a cationic water soluble polymer as described above and then adding to the mixture, while agitating same, an amount of pigment to form a dispersion wherein the cationic water soluble polymer is present in the amount of from 0.1 to 2.0 weight percent based on pigment, and then admixing the dispersion with paper making pulp. In such a method the pigment, preferably titanium dioxide, may be added as a dry solid or as an aqueous slurry, which are its commonest commecial forms. Such method can be used as a batch make-up or the admixture of water and the cationic water soluble polymer can occur in a titanium dioxide dilution water line, and in the latter case if the dilution water flow is not turbulent, an in-line mixer may be installed downstream of the inlet for the cationic water soluble polymer and upstream of the titanium dioxide inlet. In such a method the dispersion can be held prior to admixing with pulp.

PREFERRED EMBODIMENTS OF THE INVENTION

As mentioned above, the present invention is a composition and method for increasing the opacifying effectiveness of filler, particularly titanium dioxide, and improving the evenness of distribution of such filler throughout the paper sheet. It is believed that the invention promotes the deposition of the filler onto paper fibers in discrete particles or small clusters of particles providing the presence of such filler within the paper sheet at a smaller average particle size than if the filler were incorporated into the sheet solely by use of the standard flocculation method. Thus opacity, and possibly also brightness, is increased for a given level of filler. Moreover it is believed that such deposition is promoted by electrostatic attraction between anionic sites within the paper sheet and the cationic charge imparted to the filler by the present invention, and hence leads to such evenness of deposition, avoiding two-sidedness and curling of the paper. All of such advantageous effects have been demonstrated by the use of the present invention.

In addition, the positive charge imparted to the titanium dioxide filler has been demonstrated to inhibit autoflocculation of the filler upon admixture with hard water such as is found in many commerical papermachine systems.

EXAMPLES 1 TO 7

The following low molecular weight, cationic, water soluble polymers, or blends of polymers, at 1 wt. percent polymer actives based on titanium dioxide solids, each imparted a cationic charge to the titanium dioxide and formed a stable 70 weight percent solids dispersion of titanium dioxide in water:

TABLE I

| Example No. | Polymer | Molecular Wt. |
|---|---|---|
| 1 | poly epichlorohydrin/dimethylamine | 20,000 |
| 2 | ethylene dichloride/ammonia copolymer | 10,000 |
| 3 | ethylene dichloride/ammonia copolymer | 30,000 |
| 4 | poly diallyldimethylammonium chloride | 50,000 |
| 5 | polyaluminum chloride | (low) |
| 6 | blend of 95% of a 31% aqueous polyaluminum chloride solution and 5% of a 50% aqueous poly epichlorohydrin/dimethylamine solution | (low) |
| 7 | aniline/formaldehyde copolymer | less than 2,000 |

EXAMPLE 8

Using the dispersion of Example 1 above, its Zeta Potential was compared to that of a blank, i.e., a 70 weight percent solids dispersion of the same titanium dioxide without any additive, and it was demonstrated that the poly epichlorohydrin/dimethylamine imparted such a cationic charge so as to convert a negatively-charged dispersion (shown by the blank) to a positively-charged dispersion (the poly epichlorohydrin/dimethylamine treated dispersion) .The titanium dioxide used for each was a commercial titanium dioxide sold by DuPont under the tradename TRIPURE-LW, which contains an amount of anionic dispersant therein.

EXAMPLE 9

Using the same poly epichlorohydrin/dimethylamine as described in Example 1 above, and the DuPont TIPURE-LW titanium dioxide, a series of 70 weight percent solids titanium dioxide dispersions in distilled water were prepared with varying amounts of cationic polymer. The useful add-on range for this additive on such titanium dioxide was demonstrated by resultant dispersion viscosities, as shown below in Table II, which viscosities are indicative of the degree of dispersion of the particles.

TABLE II

| Wt. % Polymer on $TiO_2$ Solids | Dispersion Viscosity (cps) |
|---|---|
| 0.00 | 200 |
| 0.25 | greater than 100,000 |
| 0.4 | 3,000 |
| 0.5 | 2,800 |
| 0.7 | 3,020 |
| 1.0 | 4,000 |
| 2.0 | 6,500 |

In this Example 9, the viscosities reported above were measured on a Brookfield viscometer, and demonstrate that for titanium dioxide, and in particular the TIPURE-LW brand of titanium dioxide and the given poly epichlorohydrin/dimethylamine additive, low additive levels of the order of 0.25 weight percent on titanium dioxide solids are unsatistactory, and from a low of 2,800 cps at 0.5 weight percent polymer the viscosities rise with higher polymer levels.

EXAMPLE 10

Zeta Potential measurements for the dispersions of Example 9 above indicated a positive, but relatively low, Zeta Potential at the 0.4 wt. percent poly epichlorohydrin/dimethylamine level, which rises and then levels off between the 0.5 and 0.7 percent levels, and then begins to rise slowly.

EXAMPLE 11

A series of 70 weight percent solid titanium dioxide dispersions were prepared, similar to the series described in Example 9 above, using varying amounts of the poly epichlorohydrin/dimethylamine described in Example 1 above, except that a commercial titanium dioxide, i.e., DuPont's TIPURE LW-02 containing no anionic dispersant, was used. In each case again the dispersion viscosity was measured on a Brookfield viscometer. It was determined that starting with such a dispersant-free titanium dioxide, the preferred additive level was on the order of 0.2 wt. percent based on titanium dioxide solids. It was noted for such titanium dioxide that even a 50 weight percent solids admixture with no poly epichlorohydrin/dimethylamine was so viscous as to be offscale, although carrying a negative charge as indicated by Zeta Potential measurement.

EXAMPLE 12

For each of the titanium dioxide/additive dispersions described in the examples 1–11 above, each of which used a dry form of titanium dioxide, the following preparation method was used. The water required for the dispersion was charged into a vessel equipped with an agitator or disperser, and then the desired amount of additive was charged to such water and the agitation or dispersing commenced. The dry titanium dioxide was then added while the agitation or dispersing continued, to provide the dispersions described above.

EXAMPLE 13

Handsheets were prepared using a low level of titanium dioxide, i.e., 2.5 wt. percent on oven dried fiber. The pulp used was 50/25/25 softwood Kraft/hardwood Kraft/softwood Sulfite, beaten to 450 CSF (Canadian Standard Freeness Test units), and diluted to 0.5% consistency. In one set, TIPURE-LW titanium dioxide, supplied with an amount of anionic dispersant, was used without further treatment. In the other set, TIPURE-LW-02 (supplied without any dispersant) was treated with the 0.2 weight percent poly epichlorohydrin/dimethylamine described above in example 1 by the method described above in Example 12 before addition to the furnish. The furnish pH for both sets was tested at 4.5, 5.5, and unadjusted. The pH adjustments were made with dilute hydrochloric acid after titanium dioxide was added. For both sets five handsheets were parpared at each pH and the optical properties reported as the average of such five. The set prepared with the poly epichlorohydrin/dimethylamine treated titanium dioxide provided higher opacity and higher brightness than the TIPURE-LW titanium dioxide handsheets at each furnish pH as shown below in Table III.

TABLE III

| Titanium Dioxide Used | Percent Cationic Polymer Additive | Furnish pH | Opacity | Brightness |
|---|---|---|---|---|
| None | None | 6.75 | 85.6 | 88.6 |
| None | None | 5.5 | 85.7 | 88.9 |
| None | None | 4.5 | 85.6 | 89.0 |
| TIPURE LW | None | 6.75 | 85.7 | 89.0 |
| TIPURE LW | None | 5.5 | 85.9 | 89.7 |
| TIPURE LW | None | 4.5 | 86.2 | 89.4 |
| TIPURE LW-02 | 0.2 | 6.68 | 86.7 | 90.2 |
| TIPURE LW-02 | 0.2 | 5.5 | 86.6 | 89.8 |

TABLE III-continued

| Titanium Dioxide Used | Percent Cationic Polymer Additive | Furnish pH | Opacity | Brightness |
|---|---|---|---|---|
| TIPURE LW-02 | 0.2 | 4.5 | 86.4 | 89.5 |

EXAMPLE 14

Handsheets were prepared as described above in Example 13 with the addition of two further sets containing one lb. per ton of oven dry fiber of actives of a commercial cationic retention aid. In one the retention aid was added to TIPURE LW titanium dioxide as supplied, and in the other the retention aid was added to TIPURE LW-02 treated with the 0.2 wt. percent poly epichlorohydrin/dimethylamine. The combination of poly epichlorohydrin/dimethylamine and commercial cationic retention aid provided higher opacity and brightness levels than the poly epichlorohydrin/dimethylamine only (both on TIPURE LW-02), while the poly epichlorohydrin/dimethylamine, with and without the commercial retention aid increased optical properties when compared to untreated titanium dioxide (as TIPURE LW) or handsheets prepared with no titanium dioxide filler. These results are demonstrated by the data below in Table IV.

TABLE IV

| Titanium Dioxide | Weight Percent Poly epichlorohydrin/ dimethylamine | Cationic Retention Aid (#/Ton Fiber) | Opacity | Bright-ness |
|---|---|---|---|---|
| None | None | None | 85.7 | 88.1 |
| None | None | 1.0 | 86.2 | 87.0 |
| TIPURE LW | None | None | 85.9 | 88.3 |
| TIPURE LW | None | 1.0 | 90.4 | 87.7 |
| TIPURE LW-02 | 0.2% | None | 86.3 | 89.7 |
| TIPURE LW-02 | 0.2% | 1.0 | 90.8 | 89.0 |

EXAMPLE 15

The percent of total ash retained in the handsheets described above in Examples 13 and 14 were determined. Handsheets prepared with the poly epichlorohydrin/dimethylamine additive, with and without the commercial retention aid, had higher percentages of total retained ash than the corresponding handsheets prepared without such additive.

EXAMPLE 16

A commercial titanium dioxide slurry (DuPont's TIPURE RPS) was treated with the poly epichlorohydrin/dimethylamine described above in Example 1 as follows. The slurry was first diluted from 71.5 wt. percent solids to 30 wt. percent solids with deionized water, and then admixed with further dilution water, hard mill white water, plus the additive, at 2.5 wt. percent additive actives on titanium dioxide solids, by feeding the slurry and diluted additive separately through centrifugal pumps to a mixing chamber and then through a dispenser to provide a slurry of 20 wt. percent titanium dioxide solids. Particle mobility (u/s/V/cm) was used to determine the charge of both this treated slurry and the original slurry as supplied. The original slurry was shown to be anionic (charge of −4.47) while the treated slurry has been converted to cationic (charge of +5.89).

EXAMPLE 17

Two sets of handsheets were prepared using for one the treated titanium dioxide slurry described in Example 16 above together with 1 lb. per ton of oven dried pulp of a commercial anionic retention aid, and for the other untreated commercial titanium dioxide slurry and the same retention aid at the same level. The poly epichlorohydrin/dimethylamine treated slurry provided handsheets having a higher percentage of retained titanium dioxide and having titanium dioxide present at a higher light scattering coefficient than the handsheets prepared with the anionic retention aid alone, as shown by the data below in Table V.

TABLE V

| EPI/DMA polymer | Anionic Ret. Aid | % $TiO_2$ retained | 100S $TiO_2$ |
|---|---|---|---|
| 2.5% | 1#/Ton | 45.9 | 43.7 |
| None | Same | 38.2 | 33.7 |

EXAMPLE 18

That the present invention inhibits autoflocculation of titanium dioxide when it is introduced to the hard mill water found in many commercial papermachine systems is demonstrated as follows. Commercial titanium dioxide in slurry form was added to several different water systems each of which was under the same constant agitation, to form dispersions containing 5 wt. percent of the filler. The water systems comprised respectively distilled water, white water obtained from a commercial paper mill, a combination of such white water plus the poly epichlorohydrin-dimethylamine described in Example 1 above at a level of 0.5 wt. percent based on titanium dioxide, and such a combination with the additive at a level of 2.5 wt. percent based on titanium dioxide. From these water systems dispersion samples were taken after 30, 60, and 120 seconds of agitation after titanium dioxide addition, and the particle size distribution for each determined on an Optomax Image Analyzer which determined the number of particles within given particle diameter ranges. In the distilled water system the titanium dioxide was dispersed as very small particles while in the untreated white water system autoflocculation occurred resulting in a large mean particle size and broad particle size distribution. the poly epichlorohydrin-dimethylamine treatments, at both the 0.5 wt. percent and 2.5 wt percent levels, drastically reduced particle size and narrowed particle size distribution. The mean particle size for a given water system tended to decrease slightly with increased agitation time. The mean particle sizes for the various samples tested together with the Standard Deviation are shown below in Table VI.

TABLE VI

| Water System | Wt. % EPI/DMA Polymer on $TiO_2$ Solids | At 30 sec. agitation: Mean particle size (microns) | At 60 sec. agitation: Mean particle size (microns) | At 120 sec. agitation: Mean particle size (microns) |
|---|---|---|---|---|
| Distilled | none | 2.6 ± 2.0 | 1.5 ± 1.4 | 1.7 ± 0.9 |
| White water | none | 28.0 ± 17 | 27.7 ± 18 | 21.4 ± 13 |
| White water | 0.5 | 9.1 ± 8.6 | 8.7 ± 5.8 | 8.3 ± 5.9 |

TABLE VI-continued

| Water System | Wt. % EPI/DMA Polymer on $TiO_2$ Solids | At 30 sec. agitation: Mean particle size (microns) | At 60 sec. agitation: Mean particle size (microns) | At 120 sec. agitation: Mean particle size (microns) |
|---|---|---|---|---|
| White water | 2.5 | 7.7 ± 4.6 | 7.4 ± 6.0 | 5.1 ± 3.3 |

EXAMPLE 19

Titanium dioxide dispersions were prepared as follows. Commercial titanium dioxide slurry was added to simulated white water samples containing from zero to 1.0 weight of cationic polymer additive based on titanium dioxide solids, such additive being the poly epichlorohydrin/dimethylamine composition described in Example 1. The simulated white water was prepared by adding to 800 liters of deionized water 131.8 grams $CaCl_2.2H_2O$, 81.8 grams of $MgSO_4.7H_2O$, 403.2 grams of $NaHCO_3$, and 17 grams of $Na_2SiO_3$, and adjusting to pH 6.3 with sodium hydroxide or hydrochloric acid as necessary. The 1.0 weight percent additive based on titanium dioxide solids dosage provided a slurry with a smaller particle size and higher charge than lower dosages and the blank as shown in the following Table VII.

TABLE VII

| Wt. % EPI/DMA Copolymer on $TiO_2$ Solids | Mean Particle Size (microns) | $TiO_2$ Particle Mobility (u/s/V/cm) |
|---|---|---|
| None | 5.1 ± 4.0 | −3.11 |
| 0.25 | 2.9 ± 2.0 | −1.68 |
| 0.5 | 3.0 ± 2.1 | +0.11 |
| 1.0 | 1.5 ± 1.1 | +3.38 |

EXAMPLE 20

In a commercial papermachine producing 60 lb. high opacity paper with an opacity specification of 93.0 using 270 lb. titanium dioxide per ton of oven dry pulp. the pretreatment of the titanium dioxide slurry with one wt. percent of the poly epichlorohydrin/dimethylamine described in Example 1 above based on titanium dioxide solids increased opacity from 93.3 to 94.6 and increased first pass retention from 85.3 to 92.5 percent. Incompatibility between the additive and an anionic fluorescent brightener added in very large quantities at the wet end decreased brightness and paper sheet color. The titanium dioxide was treated with the additive by introducing the poly epichlorohydrin/dimethylamine into the titanium dioxide dilution water before admixing with the titanium dioxide (as a 71% commercial slurry) to provide a 20 wt. percent titanium dioxide dispersion. The mobility of the dispersed titanium dioxide in this system without treatment was −2.52 u/s/V/cm. This treatment converted the mobility to +3.15 u/s/V/cm. Other wet end additives used in this run as is normal commercial practice were 100 lb. calcium carbonate, 1.75 lb. sizing agent, 1.25 lb. anionic retention aid, and 2.0 lb. pitch control agent, all on a per dry ton of pulp basis, and minor amounts of dyes and colored pigments.

EXAMPLE 21

In a commercial papermachine producing 30 and 35 lb. uncoated paper grades, pretreatment of the titanium dioxide with the poly epichlorohydrin/dimethylamine described in Example 1 above reduced the titanium dioxide usage from a normal level of 70.1 lb. per ton of oven dry pulp to 27.0 lb. while maintaining the required opacity specifications. A fluorescent brightener was added only at the size press, not at the wet end as in Example 20 above, and no detrimental effect was seen on brightness nor on any other paper property. the commercial titanium dioxide was of the type supplied dry. It was first diluted to a 60 wt. percent slurry and then to a 30 wt. percent dispersion. The poly epichlorohydrin/dimethylamine additive was added to the first water of dilution before introduction of the filler. The treated titanium dioxide mobility was +3.15 u/s/V/cm. Other additives being used for this commercial production were 370 lb. calcium carbonate, 80 lb. Ansilex extender, 0.4 lb. anionic retention aid, 12 lb. alum, about 3 lb. sizing agent, 15 lb. cationic starch, all on a per ton dry pulp basis, plus a biocide, caustic for pH control, with a brightener added only at the size press.

EXAMPLE 22

Handsheets were prepared using the slurries described in example 19 above and with each commercial retentionaid system containing both a cationic and anionic retention aid. The EPI/DMA polymer additive was shown compatible with such retention aid system and to improve retention of titanium dioxide and its optical efficiency.

EXAMPLES 23 TO 27

The following low molecular weight, cationic, water soluble polymers, or blends of polymers, at 1 wt. percent polymer actives based on titanium dioxide solids, each imparted a cationic charge to the titanium dioxide and formed a stable 70 weight percent solids dispersion of titanium dioxide in water:

TABLE VIII

| Example No. | Polymer | Molecular Wt. |
|---|---|---|
| 23 | poly epichlorohydrin/ dimethylamine | less than 10,000 |
| 24 | poly epichlorohydrin/ dimethylamine | 25,000 |
| 25 | poly epichlorohydrin/ dimethylamine | 50,000 |
| 26 | poly diallyldimethyl-ammonium chloride | 100,000 |
| 27 | ethylene dichloride/ ammonia copolymer | 50,000 to 60,000 |

EXAMPLE 23

Handsheets were prepared as follows. A titanium dioxide slurry was prepared using distilled water and 0.5 weight percent of the poly epichlorohydrin/dimethylamine described in Example 1 above based on titanium dioxide solids. This slurry was then added into a commercial mill stock at 12 weight percent titanium dioxide and mixed for 3 minutes, after which normal commercial wet-end additives were added to the stock and mixing continued for an additional 2 minutes. The wet-end additives used were a commercial cationic potato starch at 10 lb. per dry ton of pulp and a sizing agent at 1.75 lb. per dry ton of pulp. The stock was then diluted with synthetic tap water to 0.5 percent consistency and the handsheets formed. These handsheets were compared to handsheets made in the same manner but without the poly epichlorohydrin/dimethylamine, and were found to be 2.5 to 3.5 points higher in opacity, of about the same brightness, higher in retained titanium dioxide, and had a titanium dioxide scattering coefficient of about 8 points higher.

EXAMPLE 29

Handsheets were prepared as described in Example 28 above including the poly epichlorohydrin/dimethylamine additive except the slurry was prepared with hard water (380 ppm total hardness) instead of distilled water. These handsheets, in comparison to the handsheets without the poly epichlorohydrin/dimethylamine additive described in Example 28 above, were from 2.6 to 3.4 points higher in opacity, of the same brightness, and had an average titanium dioxide scattering coefficient that was 10 points higher.

EXAMPLE 30

In a commercial papermachine producing a very light weight uncoated grade of paper wherein titanium dioxide was added at the level required to produce a constant sheet opacity, the pretreatment of the titanium dioxide slurry with 1.0 weight percent of the poly epichlorohydrin/dimethylamine described in Example 1 above, based on combined anhydrous clay and titanium dioxide solids, permitted the level of titanium dioxide in the sheet to be reduced from 10.75 percent to 7.99 percent while maintaining opacity and retention. The required amount of poly epichlorohydrin/dimethylamine was first admixed with an anhydrous clay and dilution water to which admixture was added a 73 weight percent solids anatase titanium dioxide slurry to form a slurry containing 50 weight percent clay and titanium dioxide solids, which later was diluted to 20 weight percent solids prior to introduction to the stock. A one to one weight ratio of clay to titanium dioxide was used. The opacity standard required was 84, and without treatment with the cationic water soluble polymer a loading of 370 lb. per dry ton of pulp of the clay/-titanium dioxide mixture was required for the standard to be m. The other additives were sodium aluminate in amount to control the pH, 0.7 lb. flocculant, 12 lb. alum, 6 lb. sizing agent, each based on dry ton pulp, and a biocide, defoamer, and various pigments. The pH was from 4.0 to 5.5 over the run.

INDUSTRIAL APPLICABILITY OF THE INVENTION

The present invention is useful in the commercial paper making industry.

I claim:

1. A method of treating a paper making pulp to increase the uniformity of titanium dioxide distribution within the web of the paper produced from said pulp comprising:

admixing with water a cationic water soluble polymer comprised of at least fifty percent by weight of repeating units consisting of a quaternary ammonium salt moiety having the structural formula of

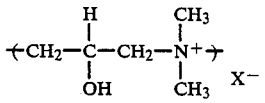

wherein X is a halide or a sulfate, said cationic water soluble polymer having a molecular weight of from 5,000 to 50,000, and agitating said mixture;

adding to said mixture of water and cationic water soluble polymer, with agitation, an amount of titanium dioxide to form a dispersion in which said cationic water soluble polymer is present in the amount of from 0.1 to 2.0 weight percent based on said titanium dioxide;

said dispersion characterized in that the charge of said dispersion is cationic and in that auto-flocculation is inhibited upon dilution of said dispersion to about 5 weight percent titanium dioxide in water; and admixing said dispersion with paper making pulp.

2. The method of claim 1 wherein said cationic water soluble polymer is a quaternary ammonium salt of an epichlorohydrin/dimethylamine copolymer.

3. The method of claim 1 wherein said titanium dioxide is added as a dry solid.

4. The method of claim 1 wherein said titanium dioxide is added as an aqueous slurry.

* * * * *